US010544952B2

(12) United States Patent
Jang et al.

(10) Patent No.: US 10,544,952 B2
(45) Date of Patent: Jan. 28, 2020

(54) AIR CONDITIONER AND METHOD OF CONTROLLING THE SAME

(71) Applicant: LG ELECTRONICS INC., Seoul (KR)

(72) Inventors: Jiyoung Jang, Seoul (KR); Pilhyun Yoon, Seoul (KR); Kakjoong Kim, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/762,196

(22) PCT Filed: May 9, 2016

(86) PCT No.: PCT/KR2016/004778

§ 371 (c)(1),
(2) Date: Mar. 22, 2018

(87) PCT Pub. No.: WO2017/057818

PCT Pub. Date: Apr. 6, 2017

(65) Prior Publication Data

US 2018/0259207 A1 Sep. 13, 2018

(30) Foreign Application Priority Data

Sep. 30, 2015 (KR) ..... 10-2015-0137604

(51) Int. Cl.
*F24F 11/30* (2018.01)
*F24F 11/72* (2018.01)
(Continued)

(52) U.S. Cl.
CPC ..... *F24F 11/30* (2018.01); *F24F 1/0003* (2013.01); *F24F 11/72* (2018.01); *F24F 2110/12* (2018.01); *F24F 2110/20* (2018.01)

(58) Field of Classification Search
CPC ..... F24F 2110/10; F24F 2110/12; F24F 2110/20; F24F 11/62; F25B 2700/2104; F25B 2700/21171
See application file for complete search history.

(56) References Cited

U.S. PATENT DOCUMENTS 6,585,494 B1 * 7/2003 Suzuki ..... F04B 27/1804 251/129.2
9,631,829 B2 * 4/2017 Kaneko ..... F24F 11/83
(Continued)

FOREIGN PATENT DOCUMENTS

JP 09014724 A * 1/1997
JP 2006-090567 4/2006
(Continued)

OTHER PUBLICATIONS

International Search Report (with English Translation) and Written Opinion dated Aug. 9, 2016 issued in Application No. PCT/KR2016/004778.

*Primary Examiner* — Nelson J Nieves
(74) *Attorney, Agent, or Firm* — Ked & Associates LLP

(57) ABSTRACT

An air conditioner and a method of controlling the same are disclosed. The air conditioner includes a controller configured to determine a target evaporation pressure based on information sensed by an outdoor temperature sensor. The controller determines whether the determined target evaporation pressure is changed, based on a difference between a value sensed by an indoor temperature sensor and a set temperature of an indoor space and a value sensed by an indoor humidity sensor.

10 Claims, 5 Drawing Sheets

(51) Int. Cl.

| | |
|---|---|
| ***F24F 1/0003*** | (2019.01) |
| *F24F 110/12* | (2018.01) |
| *F24F 110/20* | (2018.01) |

(56) References Cited

U.S. PATENT DOCUMENTS

| | | | | |
|---|---|---|---|---|
| 2005/0038567 | A1* | 2/2005 | Maeda | G05B 23/0294 700/276 |
| 2006/0236708 | A1* | 10/2006 | Mizuno | B60H 1/3219 62/228.3 |
| 2007/0068178 | A1* | 3/2007 | Honma | F25B 9/008 62/160 |
| 2008/0022706 | A1* | 1/2008 | Sakimichi | F25B 1/10 62/190 |
| 2008/0315000 | A1* | 12/2008 | Gorthala | B60H 1/00785 236/46 C |
| 2010/0175400 | A1* | 7/2010 | Kasahara | F25B 1/10 62/225 |
| 2014/0358296 | A1 | 12/2014 | Kaneko | |
| 2015/0362200 | A1* | 12/2015 | Hamada | F25B 13/00 62/175 |
| 2016/0377312 | A1* | 12/2016 | Kojima | F24F 1/0003 165/247 |

FOREIGN PATENT DOCUMENTS

| | | |
|---|---|---|
| JP | 2006-300370 | 11/2006 |
| KR | 10-2013-0041640 | 4/2013 |
| KR | 10-2015-0026208 | 3/2015 |

* cited by examiner

[Fig. 1]
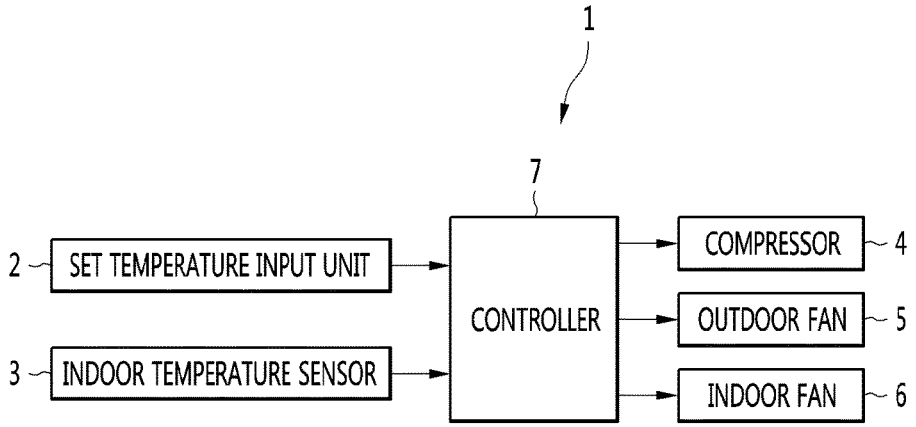
[Fig. 2]
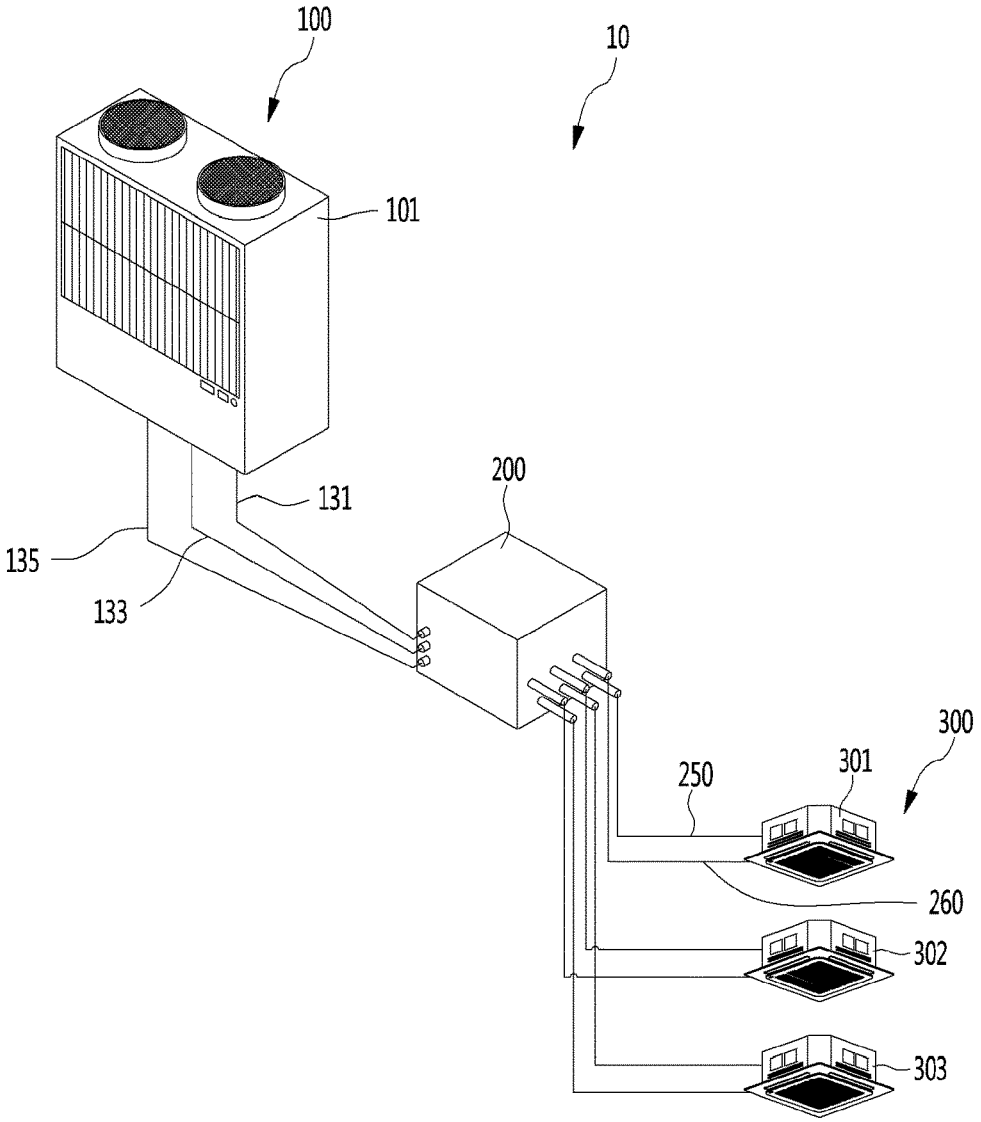

[Fig. 3]
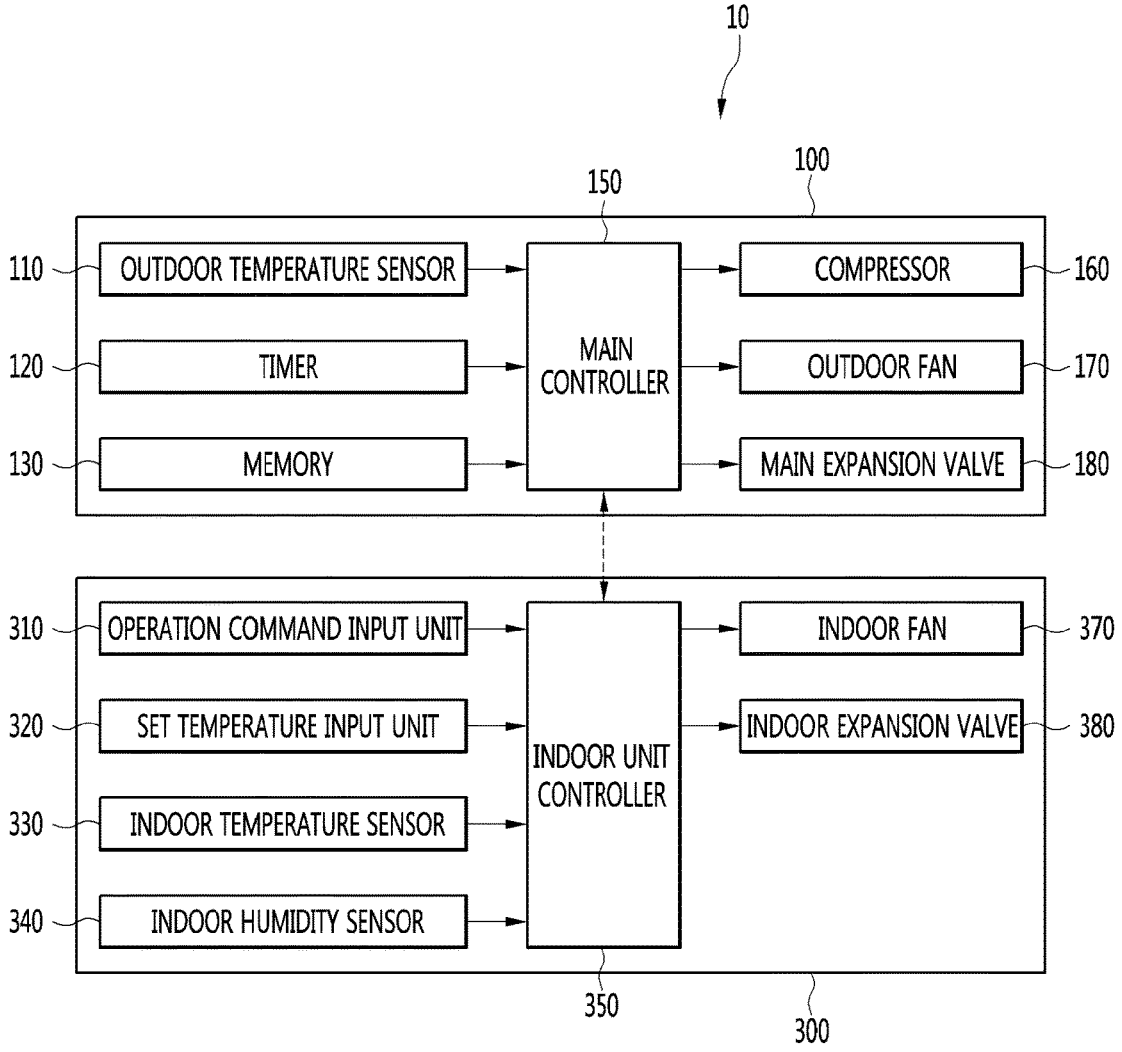
[Fig. 4]
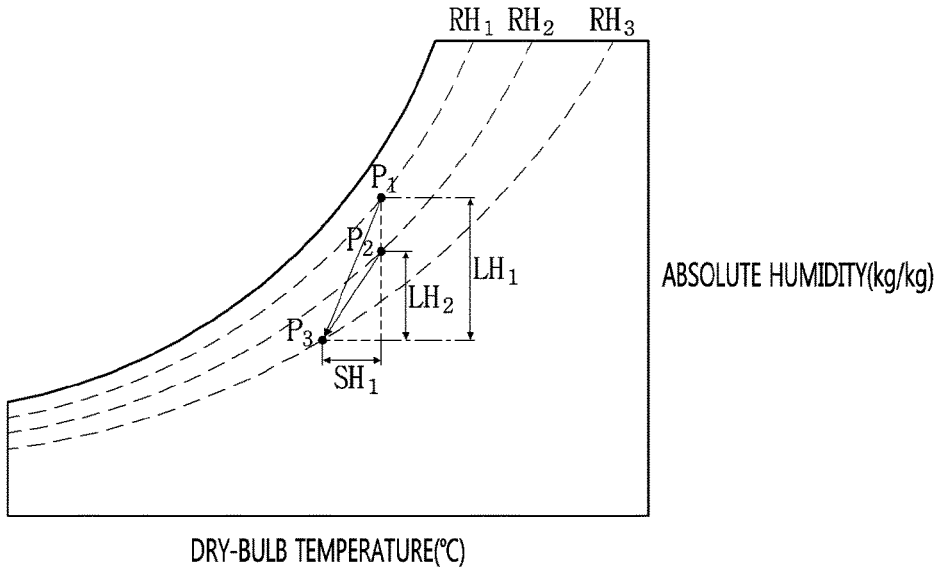

[Fig. 5]
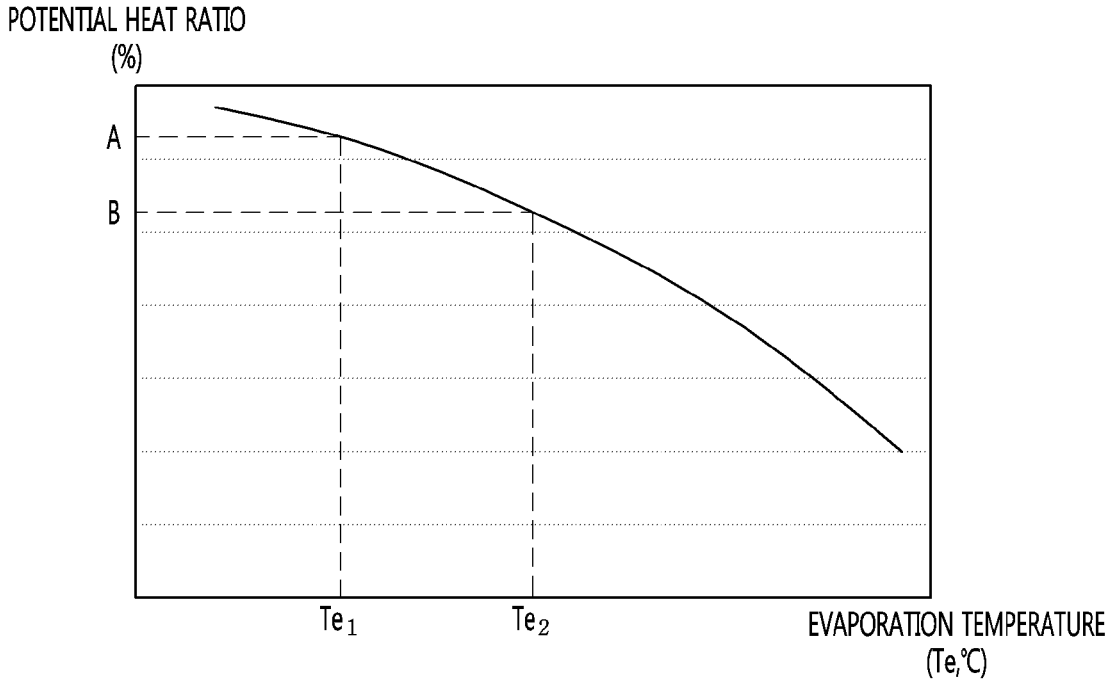
[Fig. 6]
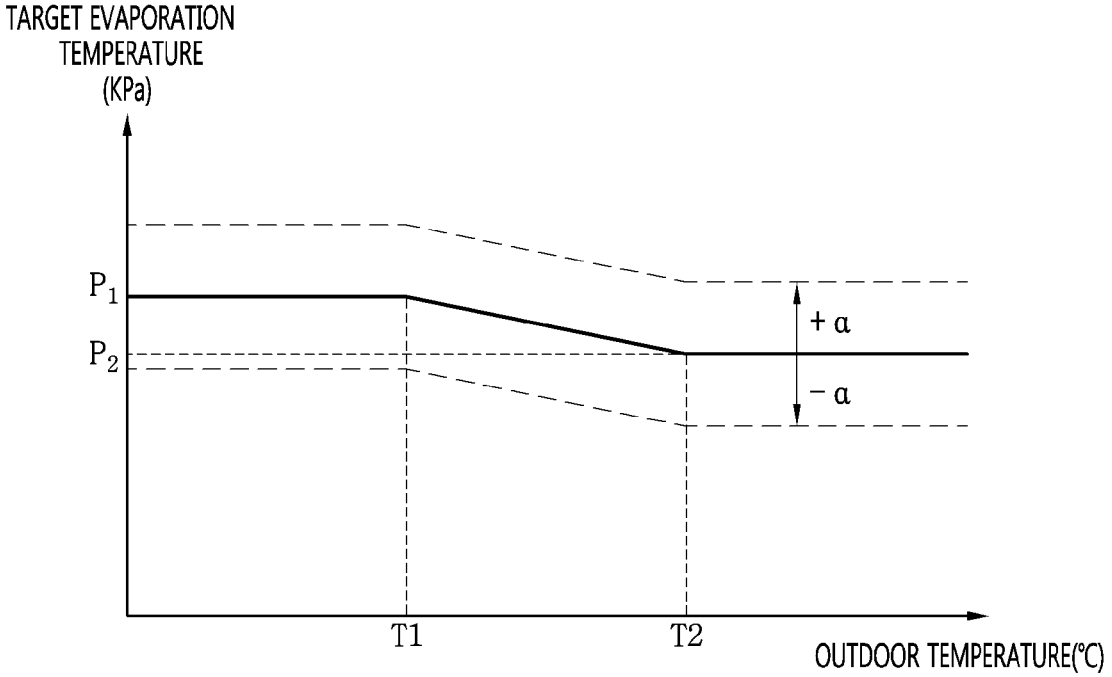

[Fig. 7]
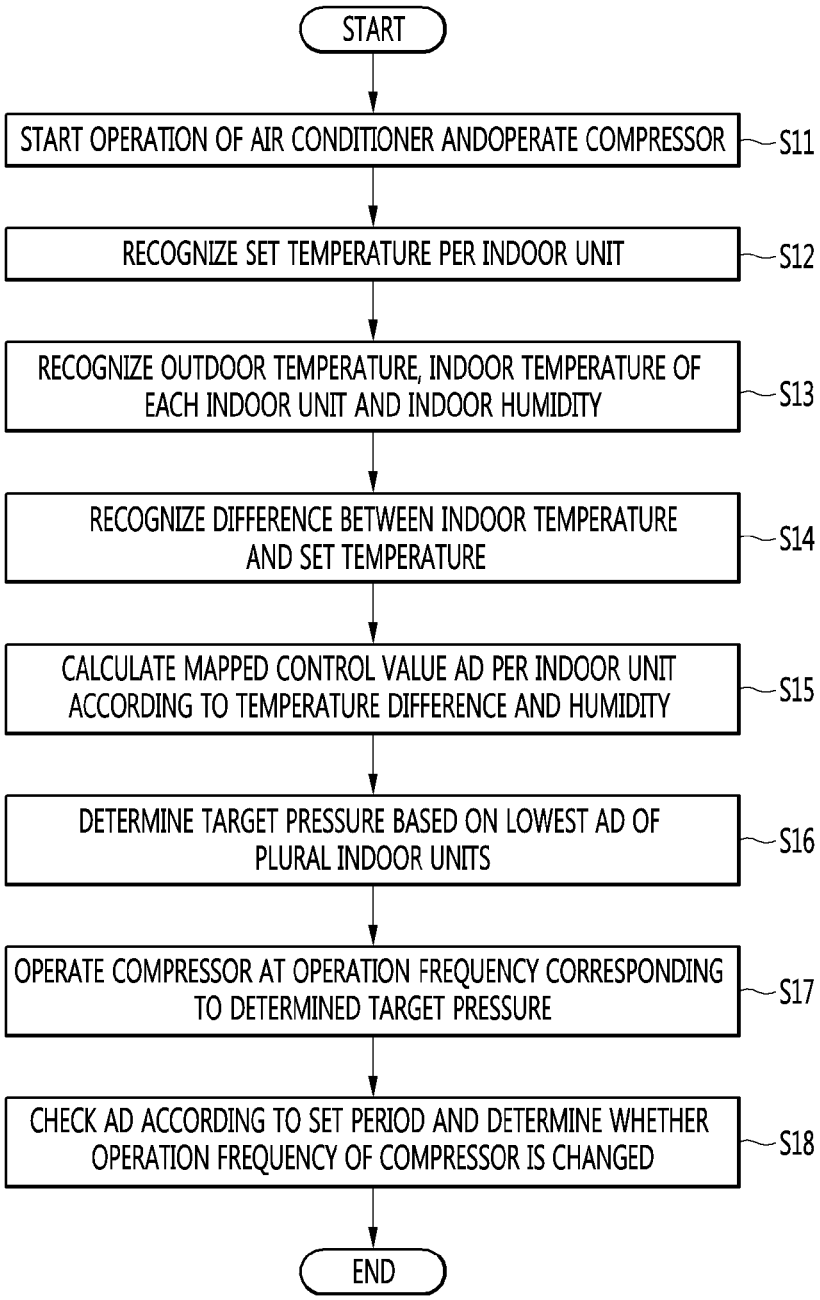

[Fig. 8]
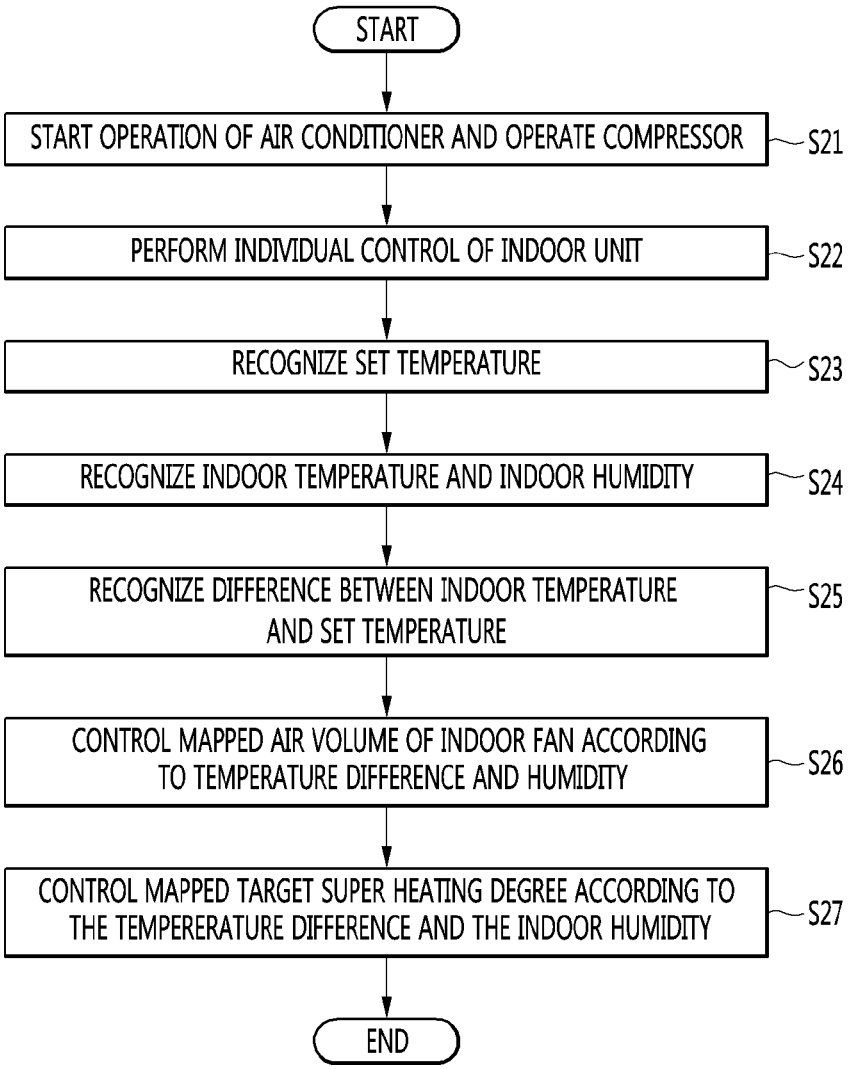

AIR CONDITIONER AND METHOD OF CONTROLLING THE SAME

CROSS-REFERENCE TO RELATED PATENT APPLICATIONS

This application is a U.S. National Stage Application under 35 U.S.C. 5371 of PCT Application No. PCT/KR2016/004778, filed May 9, 2016, which claims priority to Korean Patent Application No. 10-2015-0137604, filed Sep. 30, 2015, whose entire disclosures are hereby incorporated by reference.

TECHNICAL FIELD

The present invention relates to an air conditioner and a method of controlling the same.

BACKGROUND ART

An air conditioner is an apparatus for maintaining air of a predetermined space in an ideal state according to usage or purposes thereof. In general, the air conditioner includes a compressor, a condenser, an expansion device and an evaporator. A freezing cycle for performing compression, condensation, expansion and evaporation of refrigerant may be performed to cool or heat the predetermined space.

The predetermined space may be changed according to where the air conditioner is used. For example, when the air conditioner is positioned in home or office, the predetermined space may be an indoor space of a house or building. In contrast, when the air conditioner is positioned in a vehicle, the predetermined space may be a space into which a person gets.

When the air conditioner performs cooling operation, an outdoor heat exchanger provided in an outdoor unit performs a condensation function and an indoor heat exchanger provided in an indoor unit performs an evaporation function. In contrast, when the air conditioner performs heating operation, the outdoor heat exchanger performs a condensation function and the indoor heat exchanger performs an evaporation function.

FIG. 1 shows the configuration of a conventional air conditioner.

Referring to FIG. 1, the air conditioner 1 includes a set temperature input unit 2 for inputting the set temperature of an indoor space, an indoor temperature sensor 3 for sensing the temperature of the indoor space and a controller 7 for controlling operation of a compressor 4, an outdoor fan 5 and an indoor fan 6 based on the temperature information sensed by the indoor temperature sensor 3 and the set temperature input unit 2.

The set temperature input unit 2, the indoor temperature sensor 3 and the indoor fan 6 may be provided in an indoor unit and the compressor 4 and the outdoor fan 5 may be provided in an outdoor unit.

For example, upon performing the cooling operation of the air conditioner 1, if the temperature value sensed by the indoor temperature sensor 3 is higher than the set temperature value input via the set temperature input unit 2, the controller 7 may operate the compressor 4, the outdoor fan 5 and the indoor fan 6. Such operation may be continuously performed until the temperature of the indoor space reaches the set temperature value.

In the conventional air conditioner, operation of the compressor and a blast fan is controlled based on the temperature value of the indoor space, but humidity is not considered in operation of the air conditioner. When humidity is relatively high, a person in the indoor space may be uncomfortable.

Capacity of the air conditioner includes sensible-heat load for decreasing an indoor temperature and potential-heat load for decreasing humidity of the indoor space. When the indoor temperature or humidity is high, the air conditioner needs to decrease an evaporation temperature in order to obtain greater cooling capacity.

However, as described above, since the conventional air conditioner does not consider humidity, the conventional air conditioner is designed such that the evaporation temperature is set to be equal to or less than the set temperature in the freezing cycle, in order to display sufficient capacity even in an environment in which humidity is relatively high, such as summer.

When the air conditioner operates in an environment in which humidity is low, operation efficiency deteriorates due to excessive compression operation and a cold draft is generated due to an excessively low discharge temperature.

DISCLOSURE OF INVENTION

Technical Problem

The present invention is to solve the above-described problems and an object of the present invention is to provide an air conditioner capable of improving cooling efficiency and a method of controlling the same.

Solution to Problem

An air conditioner according to an aspect of the present invention includes a controller configured to determine a target evaporation pressure based on information sensed by an outdoor temperature sensor. The controller determines whether the determined target evaporation pressure is changed, based on a difference between a value sensed by an indoor temperature sensor and a set temperature of an indoor space and a value sensed by an indoor humidity sensor.

In addition, the air conditioner may further include a memory configured to store mapping information of the outdoor temperature and a control value AD corresponding to the target evaporation pressure.

When the indoor humidity is equal to or less than a set value, increase of the control value AD may be controlled regardless of the difference between the indoor temperature and the set temperature.

The controller may control decrease of an increment width of the control value AD as the difference between the indoor temperature and the set temperature is increased.

The indoor unit may include a plurality of indoor units, and the controller may recognize an increment or decrement width of the control value AD per indoor unit.

The controller may determine the target evaporation pressure based on a lowest control value AD of the control values AD of the plurality of indoor units.

The controller may determine a revolution count of the compressor based on the determined target evaporation pressure.

A discharged air volume of the indoor fan may be increased or decreased based on the difference between the indoor temperature and the set temperature of the indoor space and the indoor humidity.

A target super heating degree may be determined based on the difference between the indoor temperature and the set temperature of the indoor unit and the indoor humidity and an opening degree of the indoor expansion valve may be controlled based on the determined target super heating degree.

A method of controlling an air conditioner according to another aspect of the present invention includes determining a first target evaporation pressure based on an outdoor temperature, determining a second target evaporation pressure based on a difference between an indoor temperature and a set temperature and an indoor humidity, and determining a revolution count of a compressor based on the determined second target evaporation pressure.

The second target evaporation pressure may be determined according to a change value of a control value AD corresponding to the first target evaporation pressure.

The method may further include determining a revolution count of an indoor fan based on the difference between the indoor temperature and the set temperature and the indoor humidity.

The revolution count of the indoor fan may be step-controlled.

The method may further include determining a target super heating degree based on the difference between the indoor temperature and the set temperature and the indoor humidity and controlling an opening degree of an indoor expansion valve based on the target super heating degree.

Advantageous Effects of Invention

According to the air conditioner of the present invention, cooling can be controlled with high efficiency using indoor relative humidity.

In particular, if relative humidity is low, the operation frequency of the compressor may be controlled so as to increase target evaporation pressure, thereby performing high-efficiency operation. In contrast, if relative humidity is high, the operation frequency of the compressor may be controlled so as to decrease the target evaporation pressure, thereby obtaining sufficient cooling capacity.

In addition, if relative humidity is low, it is possible to prevent a cold draft from being generated due to an excessively low discharge temperature by controlling the air volume of the indoor unit and to prevent frequent thermo on/off by increasing a target indoor super heating degree to decrease cooling capacity.

In contrast, if relative humidity is high, sufficient cooling capacity can be obtained by maintaining the air volume of the indoor unit and the target indoor super heating degree at predetermined levels.

BRIEF DESCRIPTION OF DRAWINGS

FIG. 1 is a block diagram showing the configuration of a conventional air conditioner.

FIG. 2 is a diagram showing the configuration of an air conditioner according to an embodiment of the present invention.

FIG. 3 is a block diagram showing the configuration of an air conditioner according to an embodiment of the present invention.

FIG. 4 is a psychometric chart showing cooling capacity including sensible-heat load and potential-heat load of an air conditioner according to an embodiment of the present invention.

FIG. 5 is a graph showing an evaporation temperature changed according to a potential heat ratio in cooling capacities of an air conditioner according to an embodiment of the present invention.

FIG. 6 is a graph showing change of target evaporation pressure controlled according to relative humidity and an outdoor temperature in operation of an air conditioner according to an embodiment of the present invention.

FIG. 7 is a flowchart illustrating a first embodiment of a method of controlling an air conditioner according to the present invention.

FIG. 8 is a flowchart illustrating a second embodiment of a method of controlling an air conditioner according to the present invention.

MODE FOR THE INVENTION

Hereinafter, embodiments of the present invention will be described in detail with reference to the drawings. The scope of the present invention is not limited to the embodiments and those skilled in the art, who understand the concept of the present invention, may easily propose other embodiments within the scope of the invention.

FIG. 2 is a diagram showing the configuration of an air conditioner according to an embodiment of the present invention, and FIG. 3 is a block diagram showing the configuration of an air conditioner according to an embodiment of the present invention.

Referring to FIGS. 2 and 3, the air conditioner 10 according to the embodiment of the present invention includes an outdoor unit 100, a distribution unit 200 and a plurality of indoor units 300. The plurality of indoor units 300 may include a first indoor unit 301, a second indoor unit 302 and a third indoor unit 303. The number of indoor units is not limited.

In detail, the air conditioner 10 includes three pipes 131, 133 and 135 for connecting the outdoor unit 100 and the distribution unit 200. The three pipes 131, 133 and 135 include a first connection pipe 131, a second connection pipe 133 and a third connection pipe 135.

The air conditioner 10 includes a plurality of distribution pipes 250 and 260 for connecting the distribution unit 200 and the plurality of indoor units 300. The plurality of distribution pipes 250 and 260 may include an input pipe 250 for guiding inflow of refrigerant to one indoor unit 300 and an outlet pipe 260 for guiding outflow of refrigerant from one indoor unit 300. The inlet pipe 250 and the outlet pipe 260 may be provided in correspondence with the indoor units 300.

The outdoor unit 100 forms an appearance and includes a case 101 having a plurality of parts provided therein. The plurality of parts includes a compressor 160 for compressing refrigerant, an outdoor fan 170 for blowing outdoor air to an outdoor heat exchanger (not shown) and a main expansion valve 180 for expanding refrigerant.

The outdoor unit 100 further includes an outdoor temperature sensor 110 for sensing an outdoor temperature. For example, the outdoor temperature sensor 110 may be provided inside the case 101.

The outdoor unit 110 further includes a timer 120 for accumulating the elapsed time according to a predetermined condition in control of operation of the air conditioner 10. For example, the timer 120 may accumulate the operation time of the compressor 160 when the air conditioner 10 operates the compressor 160 using target evaporation pressure determined based on an outdoor temperature, an indoor temperature and indoor humidity.

The outdoor unit 110 further includes a memory 130 for storing mapping information of the target evaporation pressure or a control value AD corresponding to the target evaporation pressure in correspondence to the outdoor temperature. For example, the memory 130 may store information determined to set the target evaporation pressure to first setting pressure P1 or second setting pressure P2 or to decrease the target evaporation pressure according to increase of the outdoor temperature, depending on whether the outdoor temperature is greater or less than a first set temperature T1 or a second set temperature T2.

The memory 130 may store information on the change value of the target evaporation pressure of a freezing cycle mapped to a difference between an indoor temperature and a set temperature and indoor humidity (see Table 1).

The target evaporation pressure corresponds to low pressure of the freezing cycle and may be controlled by adjusting the operation frequency of the compressor 160. For example, when the operation frequency of the compressor 160 increases, the target evaporation pressure may be decreased and the cooling capacity of the air conditioner 10 may be increased. In contrast, when the operation frequency of the compressor 160 is decreased, the target evaporation pressure may be decreased.

In the memory 130, information on the revolution count of the indoor fan 370, that is, discharged air volume, mapped to the difference between the indoor temperature and the set temperature and the indoor humidity may be stored (see Table 2).

In the memory 130, information on the opening degree of the indoor expansion valve 380, that is, a target super heating degree, mapped to the difference between the indoor temperature and the set temperature and the indoor humidity may be stored (see Table 3).

The outdoor unit 100 further includes a main controller 150 for controlling operation of the compressor 160, the outdoor fan 170 and the main expansion valve 180 using the information on the indoor temperature, the indoor humidity and the set temperature set by a user and the information stored in the memory 130.

The indoor unit 300 includes an operation command input unit 310 for receiving input of starting operation of the indoor unit 300, a set temperature input unit 320 for receiving a desired temperature of the indoor space and an indoor temperature sensor 330 for sensing the temperature of the indoor space.

The indoor unit 300 further includes an indoor humidity sensor 340 for sensing the humidity of the indoor space. The indoor temperature sensor 330 and the indoor humidity sensor 340 may be provided on the front of the panel of the indoor unit 300 or inside the indoor unit 300.

The indoor unit 300 further includes an indoor unit controller 350 for controlling operation of the indoor fan 370 and the indoor expansion valve 380 from the information input via the operation command input unit 310 and the set temperature input unit 320 or the information recognized from the indoor temperature sensor 330 and the indoor humidity sensor 340.

The main controller 150 and the indoor unit controller 350 may be communicatively connected. The main controller 150 and the indoor unit controller 350 may be collectively referred to as a "controller?.

Another embodiment is proposed.

Although the memory 130 is provided in the outdoor unit 110 in FIG. 3, the memory 130 may be provided in the indoor unit 300.

FIG. 4 is a psychometric chart showing cooling capacity including sensible-heat load and potential-heat load of an air conditioner according to an embodiment of the present invention, and FIG. 5 is a graph showing an evaporation temperature changed according to a potential heat ratio in cooling capacities of an air conditioner according to an embodiment of the present invention.

Referring to FIG. 4, the air conditioner 10 according to the embodiment of the present invention may implement predetermined cooling capacity via cooling operation. The cooling capacity may include sensible heat capacity (load) for decreasing the indoor temperature and a potential heat capacity (load) for decreasing the indoor humidity.

The horizontal and vertical axes of the psychometric chart shown in FIG. 4 respectively indicate a dry-bulb temperature (° C.) and absolute humidity (kg/kg) and dotted lines indicate relative humidities $RH_1$, $RH_2$ and $RH_3$. For example, $RH_1$, $RH_2$ and $RH_3$ may indicate relative humidities of 80%, 50% and 30%, respectively.

Humid air defined in $P_1$ indicates that the dry-bulb temperature is $Td_1$ and the relative humidity is $RH_1$. Humid air defined in $P_2$ indicates that the dry-bulb temperature is $Td_1$ and the relative humidity is $RH_2$. That is, the dry-bulb temperatures of the humid air defined in $P_1$ and $P_2$ are identical but the relative humidity of $P_1$ is higher than that of $P_2$.

If the indoor space having humid air of $P_1$ and the indoor space having humid air of $P_2$ are cooled to be adjusted to humid air defined in $P_3$, greater cooling capacity is required to cool the indoor space having humid air of $P_1$. Here, humid air of $P_3$ indicates that the dry-bulb temperature is $Td_2$ and the relative humidity is $RH_3$. $Td_2$ is lower than $Td_1$ and $RH_3$ is lower than $RH_1$ and $RH_2$.

In detail, when the air conditioner 10 cools the indoor space having humid air of $P_1$, potential-heat load of $LH_1$ for removing humidity and sensible-heat load of $SH_1$ for decreasing the indoor temperature are necessary. That is, the cooling capacity of the air conditioner 10 is first cooling capacity $LH_1+SH_1$.

In contrast, when the air conditioner 10 cools the indoor space having humid air of $P_2$, potential-heat load of $LH_2$ for removing humidity and sensible-heat load of $SH_1$ for decreasing the indoor temperature are necessary. That is, the cooling capacity of the air conditioner 10 is second cooling capacity $LH_2+SH_1$.

Since $LH_1$ is greater than $LH_2$, the first cooling capacity is greater than the second cooling capacity. In other words, the air conditioner 10 requires greater cooling capacity to cool the indoor space having humid air of $P_1$ as compared to cooling the indoor space having humid air of $P_2$.

That is, even when the temperature is not changed, cooling capacity required to cool the indoor space having high humidity is higher than cooling capacity required to cool the indoor space having low humidity. Accordingly, if the indoor space is controlled only using the indoor temperature, when operation is performed at the same evaporation pressure, a phenomenon in which the indoor temperature is slowly decreased in the indoor space having high humidity and the indoor temperature is rapidly decreased in the indoor space having low humidity may occur.

In the present embodiment, cooling capacity is adjusted according to the indoor humidity to provide a user with a comfortable sensation and to improve operation efficiency.

Referring to FIG. 5, the evaporation temperature Te of the air conditioner 10 may be controlled to be changed according to the ratio of potential-heat load of all cooling capacities of the air conditioner. For example, when the potential-heat load is relatively high, since the amount of humidity to be removed is large, the operation frequency of the compressor 160 may be increased such that the evaporation temperature Te is decreased. In contrast, when the potential-heat load is relatively low, since the amount of humidity to be removed is small, the operation frequency of the compressor 160 may be decreased such that the evaporation temperature Te is increased.

In detail, in the vertical axis of FIG. 5, a potential heat ratio "A" indicates a potential heat ratio when cooling is performed from P1 to P3 in FIG. 4 and a potential heat ratio "B" indicates a potential heat ratio when cooling is performed from P2 to P3 in FIG. 4.

The evaporation temperature $Te_1$ when the potential heat ratio is "A" may be lower than the evaporation temperature $Te_2$ when the potential heat ratio is "B". As a result, when the potential heat ratio is "A", the cooling capacity of the air conditioner 10 is set to be large to perform comfortable operation for decreasing humidity and, when the potential heat ratio is "B", the cooling capacity of the air conditioner 10 is set to be relatively small to perform high-efficiency operation.

FIG. 6 is a graph showing change of target evaporation pressure controlled according to relative humidity and an outdoor temperature in operation of an air conditioner according to an embodiment of the present invention.

Referring to FIG. 6, the target evaporation pressure in the freezing cycle of the air conditioner 10 may be determined based on the outdoor temperature sensed by the outdoor temperature sensor 110. As described above, mapping information of the outdoor temperature and the target evaporation pressure may be pre-stored in the memory 130.

When the outdoor temperature is equal to or less than a first set temperature T1, the target evaporation pressure is set to first setting pressure $P_1$ and, when the outdoor temperature is equal to or less than a second set temperature T2, the target evaporation pressure is set to second setting pressure $P_2$. When the outdoor temperature is in a range from the first set temperature T1 to the second set temperature T2, the target evaporation pressure may be decreased according to increase of the outdoor temperature.

For control of the target evaporation pressure, a control value AD corresponding to the target evaporation pressure may be defined. For example, when the target evaporation pressure is 778 kPa, the control value AD may correspond to 85 and, when the target evaporation pressure is 974 kPa, the control value AD may correspond to 100.

The main controller 150 or the indoor unit controller 350 may control the control value AD to change the target evaporation pressure.

Based on the difference between the indoor temperature and the set temperature and the indoor humidity, the control value AD of the target evaporation pressure may be changed, that is, be increased (+a) or decreased (−a). For example, when the control value AD is changed by +1, the target evaporation pressure is increased by 15 kPa and, when the control value AD is changed by +2, the target evaporation pressure is increased by 30 kPa. In contrast, when the control value AD is changed by −1, the target evaporation pressure is decreased by 15 kPa and, when the control value is changed by −2, the target evaporation pressure is decreased by 30 kPa.

TABLE 1

| | Indoor humidity | | | |
|---|---|---|---|---|
| | 30% or less | 30% to 50% | 50% to 70% | 70% to 100% |
| (Indoor temperature − set temperature) | AD changed | AD changed | AD changed | AD changed |

TABLE 1-continued

| | Indoor humidity | | | |
|---|---|---|---|---|
| | 30% or less | 30% to 50% | 50% to 70% | 70% to 100% |
| −0.5° C. or less | +7 | +5 | +3 | +1 |
| −0.5° C. to 0.5° C. | +6 | +4 | +2 | 0 |
| 0.5° C. to 1.5° C. | +5 | +3 | +1 | −1 |
| 1.5° C. to 2.5° C. | +4 | +2 | 0 | −2 |
| 2.5° C. to 3.5° C. | +3 | +1 | −1 | −3 |
| 3.5° C. or more | +2 | 0 | −2 | −4 |

In detail, referring to Table 1, when the difference between the indoor temperature and the set temperature is small, for example, when the indoor temperature is lower than the set temperature, that is, when (indoor temperature−set temperature) is −0.5° C. in Table 1 above, since the indoor temperature is already equal to or less than a required temperature, the control value AD corresponding to the target evaporation pressure determined according to FIG. 6 is increased. As the indoor humidity is increased, the increased control value AD may be decreased.

As the control value AD is increased, the target evaporation pressure corresponding to the control value AD may be increased.

When the difference between the indoor temperature and the set temperature is large, for example, when the indoor temperature is greater than the set temperature by 3.5° C. or more, since control for significantly decreasing the indoor temperature is required, the control value AD corresponding to the target evaporation pressure determined according to FIG. 6 is decreased. For example, when the indoor humidity is in a range of 50% to 70%, the control value AD may be controlled to −2 and, when the indoor humidity is in a range of 70% to 100%, the control value AD may be controlled to −4.

However, when the indoor humidity is very low, for example, is equal to or less than 30%, a person in the indoor space may not feel hot even when the indoor temperature is relatively high. Accordingly, in this case, regardless of the difference between the indoor temperature and the set temperature, the control value AD may be increased. As the difference between the indoor temperature and the set temperature is increased, the increment width of the control value may be decreased. For example, when the difference between the indoor temperature and the set temperature is in a range of 2.5° C. to 3.5° C., the control value AD may be increased by +3 and, when the indoor temperature is greater than the set temperature by 3.5° C. or more, the control value AD may be increased by +2 to increase the target evaporation pressure.

As shown in Table 1, if the indoor humidity is equal to or less than 50%, even when the indoor temperature is greater than the set temperature, the control value AD may be increased. In summary, if the indoor humidity is equal to or less than the set humidity, even if the indoor temperature is higher than the set temperature, the control value AD corresponding to the target evaporation pressure determined in FIG. 6 may be increased.

In change of the control value AD shown in Table 1, when the control value AD is decreased (−a), the revolution count of the compressor 160 is controlled to be higher than the revolution corresponding to the target evaporation pressure determined in FIG. 6. Accordingly, the cooling capacity of the air conditioner 10 may be increased and the indoor temperature may be decreased.

In contrast, when the control value AD is increased (+a), the revolution count of the compressor 160 is controlled to be lower than the revolution corresponding to the target evaporation pressure determined in FIG. 6. As a result, when the control value AD is increased, power-saving operation of the air conditioner 10 may be performed.

Based on the difference between the indoor temperature and the set temperature and the indoor humidity, the revolution count of the indoor fan 370, that is, discharged air volume, may be controlled. If the indoor humidity is relatively low, even when the indoor temperature is relatively high, a person in the indoor space does not feel hot. Accordingly, when the difference between the indoor temperature and the set temperature is not greater than the setting value and the indoor humidity is relatively low, the revolution count of the indoor fan 370 may be decreased to decrease the discharged air volume.

TABLE 2

| | Indoor humidity | | | |
|---|---|---|---|---|
| | 30% or less | 30% to 50% | 50% to 70% | 70% to 100% |
| (Indoor temperature − set temperature) | Control of revolution count of indoor fan | Control of revolution count of indoor fan | Control of revolution count of indoor fan | Control of revolution count of indoor fan |
| −0.5° C. or less | Air volume is decreased by 2 stages | Air volume is decreased by 2 stages | | |
| −0.5° C. to 0.5° C. | Air volume is decreased by 1 stage | Air volume is decreased by 1 stage | | |
| 0.5° C. to 1.5° C. | Air volume is decreased by 1 stage | Air volume is decreased by 1 stage | | |
| 1.5° C. to 2.5° C. | | | | |
| 2.5 to 3.5° C. | | | | |
| 3.5° C. or more | | | | |

Referring to Table 2, based on the difference between the indoor temperature and the set temperature and the indoor humidity, step control of the discharged air volume of the indoor fan 370 may be performed. In general, at the indoor humidity of 50% to 60%, the indoor space is relatively comfortable.

For example, when (indoor temperature−set temperature) is −0.5° C. in a state in which the indoor humidity is 30% or less, the discharged air volume of the indoor fan 370 is controlled to be lower than the set air volume by 2 stages and, when (indoor temperature−set temperature) is in a range of −0.5° C. to 1.5° C., the discharged air volume of the indoor fan 370 is controlled to be lower than the set air volume by 1 stage. When (indoor temperature−set temperature) is 1.5° C. or more, the set air volume may be maintained.

When (indoor temperature−set temperature) is −0.5° C. in a state in which the indoor humidity is in a range from 30% to 50%, the discharged air volume of the indoor fan 370 is controlled to be lower than the set air volume by 2 stages and, when (indoor temperature−set temperature) is in a range of −0.5° C. to 1.5° C., the discharged air volume of the indoor fan 370 is controlled to be lower than the set air volume by 1 stage. When (indoor temperature−set temperature) is 1.5° C. or more, the set air volume may be maintained.

When the indoor humidity is 50% or more, the set air volume may be controlled to be maintained regardless of the (indoor temperature−set temperature).

When the indoor humidity is relatively low, although the indoor temperature does not satisfy the set temperature, a person in the indoor space does not relatively feel hot. Therefore, the discharged air volume of the indoor fan 370 may be decreased to perform power-saving operation.

Based on the difference between the indoor temperature and the set temperature and the indoor humidity, a target super heating degree of the freezing cycle may be controlled. The target super heating degree may be controlled by adjusting opening degree of the indoor expansion valve 380. For example, when opening degree of the indoor expansion valve 380 is decreased and the amount of refrigerant flowing into the indoor unit 300 is decreased, the target super heating degree may be increased. In contrast, when opening degree of the indoor expansion valve 380 is increased and the amount of refrigerant flowing into the indoor unit 300 is increased, the target super heating degree may be decreased.

When the indoor humidity is relatively low, even when the indoor temperature is relatively high, a person in the inner space does not feel hot. Accordingly, when the difference between the indoor temperature and the set temperature is not greater than the setting value and the indoor humidity is relatively low, the target super heating degree may be increased to decrease cooling capacity. Accordingly, it is possible to prevent frequent thermo on/off.

Here, thermo off means that the indoor temperature reaches the set temperature to close the indoor expansion valve of the indoor unit such that refrigerant flow is blocked and the indoor fan 370 operates with a set revolution count (cooling stop state) and thermo on means that the indoor temperature is increased to be higher than the set temperature to open the indoor expansion value and the indoor fan 370 operates to perform cooling.

By preventing repeated thermo on/off, it is possible to prevent the person in the indoor space from feeling a cold draft when the indoor unit operates and from feeling hot when cooling of the indoor unit is stopped and to continuously perform comfortable operation.

TABLE 3

| | Indoor humidity | | | |
|---|---|---|---|---|
| | 30% or less | 30% to 50% | 50% to 70% | 70% to 100% |
| (Indoor temperature − set temperature) | Control of target super heating degree | Control of target super heating degree | Control of target super heating degree | Control of target super heating degree |
| −0.5° C. or less | +2° C. | +2° C. | 0 | 0 |
| −0.5° C. to 0.5° C. | +2° C. | +1° C. | 0 | 0 |
| 0.5° C. to 1.5° C. | +1° C. | +1° C. | 0 | 0 |
| 1.5° C. to 2.5° C. | +1° C. | +1° C. | 0 | 0 |
| 2.5° C. to 3.5° C. | 0 | 0 | 0 | 0 |
| 3.5° C. or more | 0 | 0 | 0 | 0 |

Referring to Table 3, based on the difference between the indoor temperature and the set temperature and the indoor humidity, the target super heating degree may be controlled.

For example, when (indoor temperature−set temperature) is −0.5° C. in a state in which the indoor humidity is 30% or less, the opening degree of the indoor expansion valve 380 may be decreased such that the target super heating degree is increased by 2° C. and, when (indoor temperature−set temperature) is in a range of −0.5° C. to 2.5° C., the opening degree of the indoor expansion valve 380 may be decreased such that the target super heating degree is increased by 1° C. Of course, as the increment value of the target super heating degree is increased, the opening degree of the indoor expansion valve 380 may be further decreased. When (indoor temperature−set temperature) is 2.5° C. or more, the target super heating degree may be maintained.

When (indoor temperature−set temperature) is −0.5° C. in a state in which the indoor humidity is in a range from 30% to 50%, the opening degree of the indoor expansion valve 380 may be decreased such that the target super heating degree is increased by 2° C. and, when (indoor temperature−set temperature) is in a range of −0.5° C. to 2.5° C., the opening degree of the indoor expansion valve 380 may be decreased such that the target super heating degree is increased by 1° C. When (indoor temperature−set temperature) is 2.5° C. or more, the target super heating degree may be maintained.

When the indoor humidity is 50% or more, the target super heating degree may be controlled to be maintained regardless of the (indoor temperature−set temperature).

When the indoor humidity is relatively low, even when the indoor temperature does not satisfy the set temperature, a person in the indoor space does not feel hot. Accordingly, by increasing the target super heating degree, it is possible to decrease cooling capacity. Therefore, it is possible to prevent a person in the indoor space from feeling a cold draft and to perform power-saving operation.

Hereinafter, a method of controlling an air conditioner according to the present invention will be described. The operation command input unit 310 of the indoor unit 300 may include an input unit for performing "comfortable power-saving operation" (comfortable power-saving operation input unit). When comfortable power-saving operation is selected via the comfortable power-saving operation input unit, any one or both of the control methods of FIGS. 7 and 8 may be performed.

FIG. 7 is a flowchart illustrating a first embodiment of a method of controlling an air conditioner according to the present invention, and FIG. 8 is a flowchart illustrating a second embodiment of a method of controlling an air conditioner according to the present invention.

First, referring to FIG. 7, when cooling operation of the air conditioner 10 starts by a command input via the operation command input unit 310 according to the embodiment of the present invention, the compressor 160 is operated. A user may input the set temperature of the indoor space via the set temperature input unit 320.

In addition, operation of the plurality of indoor units may start. One or more indoor units may be provided in one indoor space. A plurality of indoor spaces may exist (S11).

The control operation of the plurality of indoor units is performed.

In detail, the set temperature of each indoor unit 300 may be recognized. Through the outdoor temperature sensor 110, the indoor temperature sensor 330 and the indoor humidity sensor 340, information on the outdoor temperature and information on the indoor temperature and humidity of each indoor space in which the indoor unit is provided are recognized (S12 and S13).

Based on the outdoor temperature, basic target evaporation pressure (first target evaporation pressure) may be determined (see FIG. 6). As shown in Table 1, the difference between the indoor temperature and the set temperature is recognized and the mapped change value of the control value AD is calculated per indoor unit according to the temperature difference and the indoor humidity (S14 and S15).

Through the calculated value of each indoor unit, the target evaporation pressure is determined based on a lowest control value (AD) of the plurality of indoor units 301, 302 and 303. At this time, the target evaporation pressure newly determined according to the AD change value may be referred to as "second target evaporation pressure?.

In detail, the AD change value may be differently calculated according to indoor units. In this case, the target evaporation pressure is determined based on the AD change value of the indoor unit in the worst state, that is, requiring largest cooling capacity, the indoor space in which the indoor unit is provided is sufficiently cooled.

When the second target evaporation pressure is determined, the operation frequency of the compressor 160 corresponding to the determined second target evaporation pressure is determined and the compressor 160 operates at the determined operation frequency.

By determining the target evaporation pressure in consideration of the indoor temperature and the indoor humidity and based on the difference between the indoor temperature and the set temperature, it is possible to efficiently perform operation (power-saving operation) of the air conditioner (S16, S17).

Such control may be repeatedly performed in a set period. That is, when the setting time elapses after starting the operation of the compressor 160 at the determined operation frequency, steps S12 to S17 are performed again to check the control value AD and to determine new target evaporation pressure, thereby determining whether the operation frequency of the compressor 160 is changed (S18).

Based on the difference between the indoor temperature and the set temperature and the indoor humidity, control of the indoor fan 370 described in Table 2 and control of the indoor expansion valve 380 described in Table 3 may be performed.

Next, referring to FIG. 8, when cooling operation of the air conditioner 10 starts by a command input via the operation command input unit 310 according to the embodiment of the present invention, the compressor 160 is operated. A user may input a set temperature of the indoor space via the set temperature input unit 320 (S21).

Individual control of the indoor unit may be performed (S22).

In detail, the set temperature of the indoor unit 300 may be recognized. Through the indoor temperature sensor 330 and the indoor humidity sensor 340, information on the indoor temperature and humidity of the indoor space is recognized (S23 and S24).

As described in Table 2, the difference between the indoor temperature and the set temperature is recognized and the mapped discharged air volume of the indoor fan 370 may be controlled according to the temperature difference and the indoor humidity. At this time, step control of the indoor fan 370 may be performed. Through control of the indoor fan 370, it is possible to prevent a person in the indoor space from feeling a cold draft (S25 and S26).

As described in Table 3, according to the temperature difference and the indoor humidity, the mapped target super heating degree may be controlled. In order to control the target super heating degree, the opening degree of the indoor expansion valve 380 may be controlled. Through control of the target super heating degree, it is possible to prevent frequent thermo on/off and to continuously perform comfortable operation (S27).

INDUSTRIAL APPLICABILITY

According to the air conditioner of the present invention, since cooling may be efficiently controlled using the relative indoor humidity, industrial applicability is achieved.

The invention claimed is:

1. An air conditioner comprising:

an outdoor unit including a compressor and an outdoor temperature sensor to sense an outdoor temperature;

at least one indoor unit connected to the outdoor unit;

an indoor temperature sensor provided in the at least one indoor unit to sense an indoor temperature;

an indoor humidity sensor provided in the at least one indoor unit to sense an indoor humidity; and a controller configured to determine a target evaporation pressure based on information sensed by the outdoor temperature sensor, wherein the controller determines a change to the determined target evaporation pressure, based on a difference between the indoor temperature sensed by the indoor temperature sensor and a set temperature of an indoor space, and the indoor humidity sensed by the indoor humidity sensor, and wherein the controller controls increase of at least one control value regardless of the difference between the indoor temperature and the set temperature when the indoor humidity is equal to or less than a set value, the control value corresponding to the target evaporation pressure.

2. The air conditioner according to claim 1, further comprising a memory configured to store mapping information of the outdoor temperature and the control value.

3. The air conditioner according to claim 2, wherein the memory stores information on change of the control value mapped to the difference between the indoor temperature and the set temperature of the indoor space, and the indoor humidity.

4. The air conditioner according to claim 1, wherein the controller controls decrease of an increment value of the control value as the difference between the indoor temperature and the set temperature is increased.

5. The air conditioner according to claim 2, wherein:

the at least one indoor unit includes a plurality of indoor units, the at least one control value includes a plurality of control values, each of the control values correspond to each of the indoor units respectively, and the controller increment or decrement value of the control values.

6. The air conditioner according to claim 5, wherein the controller determines the target evaporation pressure based on a lowest control value of the control values of the plurality of indoor units.

7. The air conditioner according to claim 1, wherein the controller determines a revolution count of the compressor based on the determined target evaporation pressure.

8. The air conditioner according to claim 1, further comprising an indoor fan provided in the at least one indoor unit, wherein the controller increases or decreases a discharged air volume of the indoor fan based on the difference between the indoor temperature and the set temperature of the indoor space, and the indoor humidity.

9. The air conditioner according to claim 1, further comprising an indoor expansion valve provided in the indoor unit, wherein the controller determines a target super heating degree based on the difference between the indoor temperature and the set temperature of the at least one indoor unit, and the indoor humidity and controls an opening degree of the indoor expansion valve based on the determined target super heating degree.

10. An air conditioner, comprising;

an outdoor unit including a compressor and an outdoor temperature sensor to sense an outdoor temperature;

at least one indoor unit connected to the outdoor unit;

an indoor temperature sensor provided in the at least one indoor unit to sense an indoor temperature;

an indoor humidity sensor provided in the at least one indoor unit to sense an indoor humidity;

a controller configured to determine a target evaporation pressure based on information sensed by the outdoor temperature sensor, wherein the controller determines a change to the determined target evaporation pressure, based on a difference between the indoor temperature sensed by the indoor temperature sensor and a set temperature of the indoor space, and the indoor humidity sensed by the indoor humidity sensor; and a memory configured to store mapping information of the outdoor temperature and at least one control value, wherein the at least one control value corresponds to the target evaporation pressure, wherein the at least one indoor unit includes a plurality of indoor units, the at least one control value includes a plurality of control values, each of the control values correspond to each of the indoor units respectively, the at least one control value includes a plurality of control values, each of the control values correspond to each of the indoor units respectively, and the controller recognizes an increment or decrement value of the control values, and wherein the controller determines the target evaporation pressure based on a lowest control value of the control values of the plurality of indoor units.

* * * * *